US005671471A

United States Patent [19]

Mizuno et al.

[11] Patent Number: 5,671,471

[45] Date of Patent: Sep. 23, 1997

[54] SHEET SEPARATING DEVICE

[75] Inventors: Naoki Mizuno, Toyokawa; Toshio Sakata, Toyohashi; Toshio Toyama, Sakai, all of Japan

[73] Assignees: Minolta Co., Ltd.; Toyama Machineries Co., Ltd., both of Osaka, Japan

[21] Appl. No.: 731,969

[22] Filed: Oct. 23, 1996

Related U.S. Application Data

[63] Continuation of Ser. No. 364,232, Dec. 27, 1994.

[30] Foreign Application Priority Data

Dec. 28, 1993 [JP] Japan ..... 5-334844

[51] Int. Cl.[6] ..... G03G 15/14; G03G 15/16; G03G 15/20

[52] U.S. Cl. ..... 399/297; 271/307; 399/323; 399/398

[58] Field of Search ..... 399/297, 323, 399/398, 399; 271/307, 308, 311, 900

[56] References Cited

U.S. PATENT DOCUMENTS

| | | | |
|---|---|---|---|
| 3,885,786 | 5/1975 | Schmalzbauer | 271/311 |
| 3,918,702 | 11/1975 | Mihalik et al. | 271/311 |
| 3,981,085 | 9/1976 | Franko | 355/315 |
| 4,060,320 | 11/1977 | Doi et al. | 355/315 |
| 4,408,757 | 10/1983 | Yarm | 271/311 |
| 4,571,056 | 2/1986 | Tani et al. | 355/315 |
| 4,771,310 | 9/1988 | Leo et al. | 399/323 |
| 4,796,880 | 1/1989 | Tamary | 271/311 |
| 4,821,064 | 4/1989 | Mills et al. | 355/315 |
| 4,905,049 | 2/1990 | Bickerstaff et al. | 399/325 |
| 5,053,830 | 10/1991 | Arai | 399/323 |
| 5,142,339 | 8/1992 | Kasahara et al. | 355/282 |
| 5,160,130 | 11/1992 | Fromm et al. | 271/307 |
| 5,532,810 | 7/1996 | Cahill | 399/323 |

FOREIGN PATENT DOCUMENTS

| | | |
|---|---|---|
| 54-170839 | 12/1979 | Japan . |
| 56-150947 | 11/1981 | Japan . |

*Primary Examiner*—William J. Royer

*Attorney, Agent, or Firm*—Burns, Doane, Swecker & Mathis, LLP

[57] ABSTRACT

A separating pawl is attached to a fixed portion around a rotatable member, and a separating end of the separating pawl extends from a fixed end of the separating pawl onto a circumferential surface of the rotatable member. A portion between the separating end and the fixed end of the separating pawl forms a convex arch in the same direction as that of the rotatable member. A pressing plate is attached to the fixed portion around the rotatable member, and is brought in contact with the convex side of the separating pawl so that the separating end of the separating pawl comes in contact with the rotatable member to press the separating pawl for performing a sheet separating operation.

25 Claims, 8 Drawing Sheets

SHEET SEPARATING DEVICE

This application is a continuation of application Ser. No. 08/364,232, filed Dec. 27, 1994.

BACKGROUND OF THE INVENTION

1. Technical Field of the Invention

The present invention relates to a sheet separating device for separating a sheet from a circumferential surface of a rotatable member.

2. Description of Related Art

In a fixing roller known as a fixing device which is provided in an electrophotographic copying machine, for instance, when a sheet is transported between a pair of rotating rollers by pressing the rollers in contact with each other, there occurs a problem that the sheet becomes wound around the rollers. In order to prevent such a troublesome winding, it has heretofore been practiced to utilize a sheet separating device.

The sheet separating device has been applied to a photoconductor wherein a sheet being transported is brought in contact with the photoconductor electrostatically or by a transfer roller, or to a rotatable member such as an intermediate transfer drum wherein a sheet is held on the circumferential surface of the rotatable member, and is separated and forwarded for a subsequent process after an image is transferred.

A conventional sheet separating device is provided with a separating pawl as a separating member for separating a sheet from a surface of a rotatable member which tends to be wound around with the sheet. The separating pawl is generally formed with a rigid body such as resin, and the leading end of the pawl is urged by a spring to be pressed in contact with a surface of the rotatable member which tends to be wound around with a sheet.

A sheet which passes through a fixing roller which tends to be wound around with the sheet is guided by the separating pawl and peeled off from the surface of the rotatable member whereby the rotatable member is protected from being wound around with the sheet. Published unexamined utility model application No. 170839/1979 discloses one of such sheet separating devices.

A conventional separating pawl which is arranged to be pressed in contact with a surface of a rotatable member is made of a rigid body such as resin, and therefore, a state of pressed contact is largely affected by accuracy of part by which the separating pawl is manufactured and how accurately the separating pawl is assembled and installed. However, there are difficulties in obtaining said accuracy, and moreover, by wear of a surface of the rotatable member or by wear of the leading end of separating pawl, the leading end of the separating pawl can not be brought in contact with the surface of the rotatable member accurately and securely. Under such a condition, a sheet being transported along the surface of the rotatable member is apt to wind around the rotatable member since the sheet can not be separated from the surface of the rotatable member by the leading end of the separating pawl.

Furthermore, if there occurred a paper jam at the periphery of the separating pawl for some reason, a load is put on the separating pawl by the jammed paper in addition to a load normally placed, and the separating pawl eventually cuts into the rotatable member, or the rotatable member is possibly broken by the separating pawl.

SUMMARY

A primary object of the present invention is to provide a sheet separating device which is capable of surely separating a sheet over a long period of time and is excellent in durability without being affected by external force and a change in accuracy with the passage of time.

Another object of the present invention is to provide a sheet separating device which is not affected by product accuracy of a separating member, and wear of a rotatable member wherein the separating member is satisfactorily brought in contact with a surface of the rotatable member over a long period of time, and even if a lead is added by a jammed paper in addition to a lead normally placed, the separating member does not cut into the surface of the rotatable member to break the member.

These and other objects and features of the present invention will become more apparent from the following description taken in conjunction with the accompanying drawings which illustrate specific embodiments of the invention.

DESCRIPTION OF THE PREFERRED EMBODIMENTS

Description will now be made hereinafter on some of embodiments of the present invention referring to the accompanying drawings.

FIGS. 1 through 9 show a first embodiment of the present invention.

Figure 1:
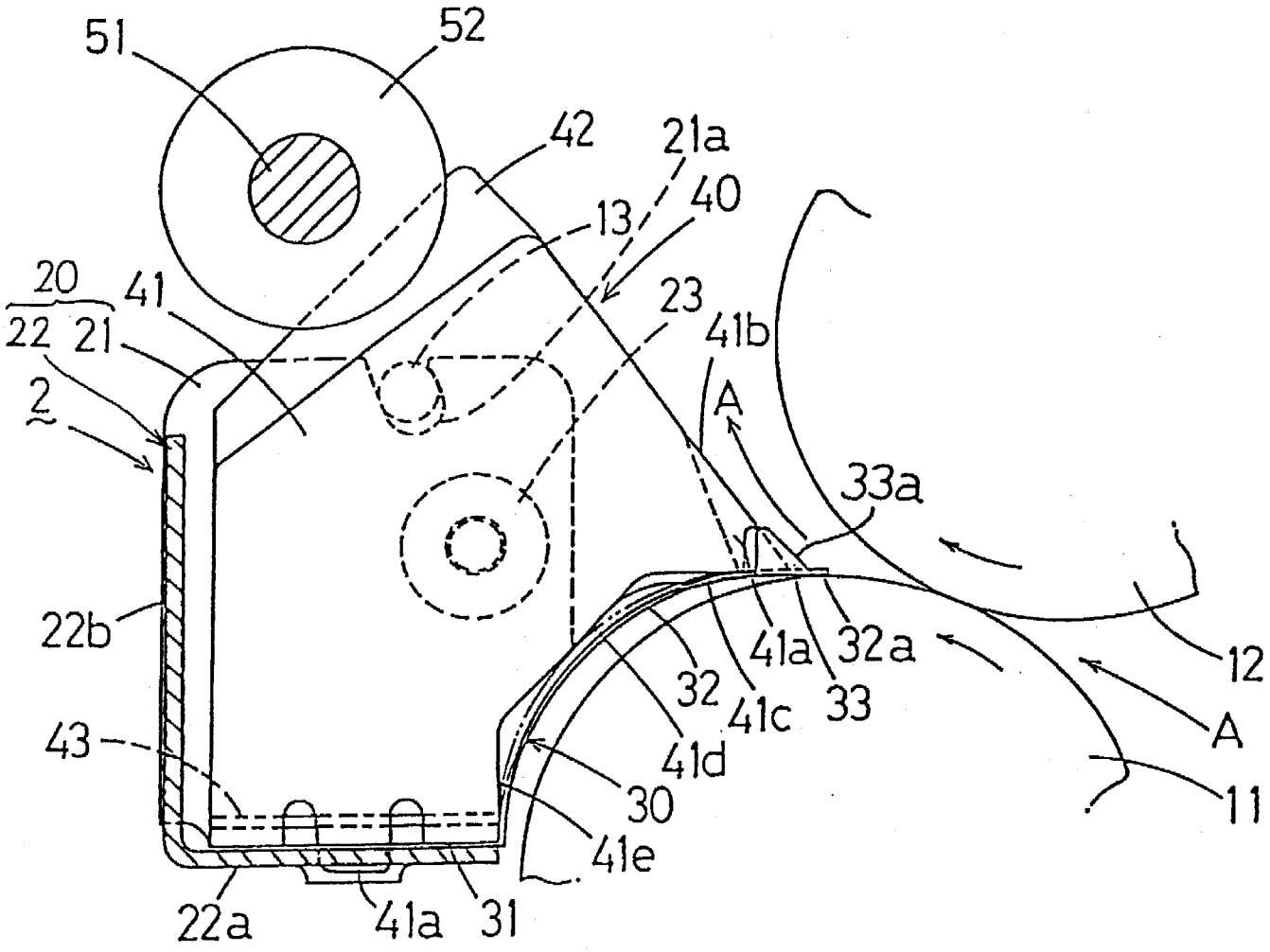
FIG. 1 is a sectional view showing a first embodiment of a sheet separating device of the present invention.

As illustrated in FIG. 1, the present embodiment is applied to a fixing device wherein an upper pressure roller 12 is pressed in contact with a lower transport roller 11. The transport roller 11 and pressure roller 12 transport a sheet toward a direction of A shown by an arrow with rotation of the rollers in the directions shown by arrows in the figure, and a toner image electrophotographically formed on the sheet is fixed.

Figure 2:
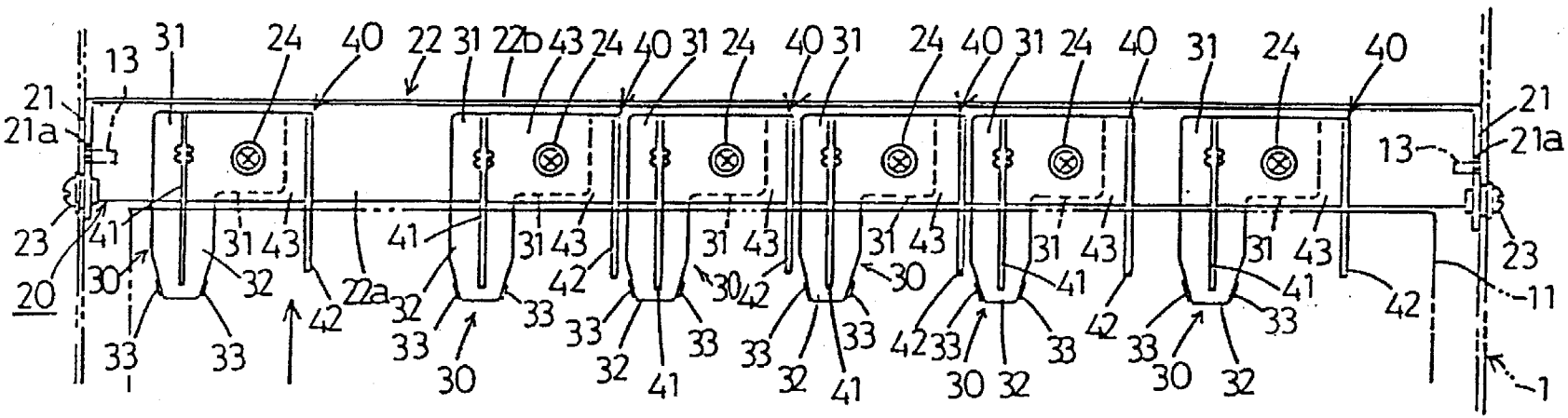
FIG. 2 is a plan view illustrating a separating pawl holder of the device shown in FIG. 1.

As shown in FIGS. 1 and 2, a sheet separating device 2 is applied to the transport roller 11 as a rotatable member which tends to be wound around by the sheet. The separating device 2 is provided with a separating pawl holder 20 as a fixed portion around a circumference of the transport roller 11. The sheet separating device 2 is arranged on the downstream side of the transport roller 11 in a direction a sheet is transported by the transport roller 11.

The separating pawl holder 20 stretches substantially an overall length of the transport roller 11, and comprises side plates 21 vertically positioned at both ends of the holder 20 and a main body 22 in L-shape in cross section provided between each of the side plates 21.

As illustrated in FIG. 2, each of the side plates 21 is attached to a sheet transport device 1 with a screw 23, and on the upper portion of each side plate 21, there is arranged a positioning groove 21*a* cut from an upper edge. A positioning pin 13 attached to the sheet transport device 1 is engaged with the positioning groove 21*a* whereby each side plate 21 is positioned in a predetermined posture centering around the screw 23.

The main body 22 of the separating pawl holder 20 is provided with a base 22*a* substantially in a horizontal state and a back 22*b* vertically bent upward from a far side edge of the transport roller 11 at the base 22*a*. However, the base 22*a* is inclined a little so as to have the far side edge from the transport roller 11 to be positioned a little lower than a side edge portion of the transport roller 11.

On the base 22*a* of the main body 22 in the separating pawl holder 20, there are provided six separating members 30 at predetermined positions in a longitudinal direction as shown in FIG. 2. Above each one of the separating members 30, a sheet guide member 40 which is used also as an auxiliary member is arranged to protect the separating member 30.

Figure 3:
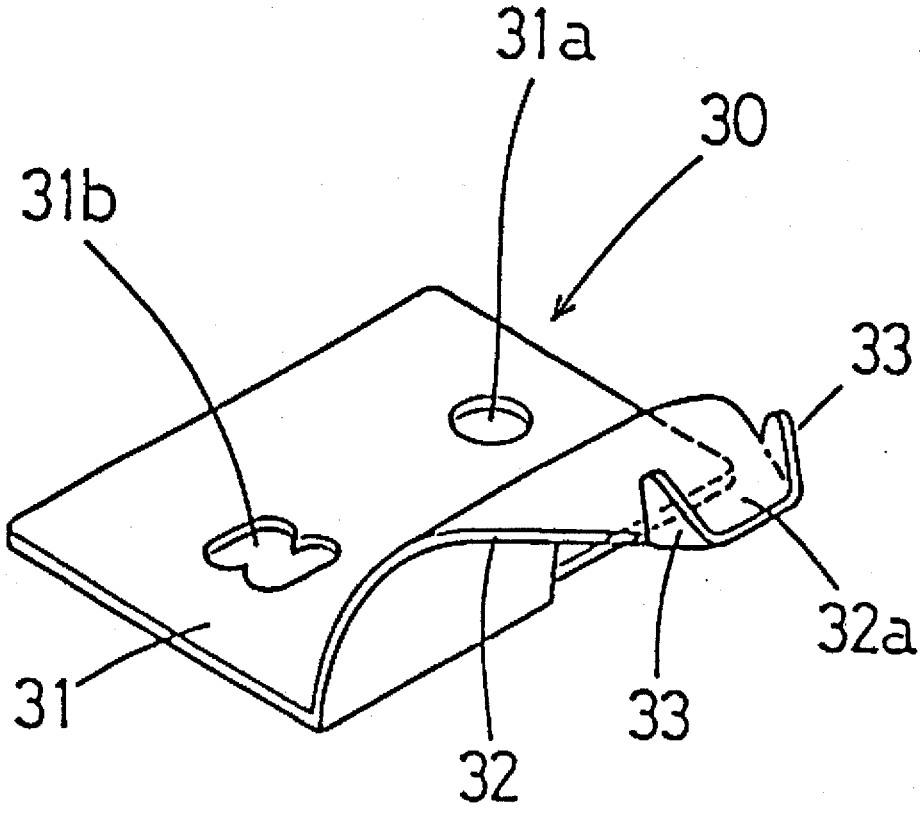
FIG. 3 is a perspective view illustrating an example of a separating pawl of the device shown in FIG. 1.

Each one of the separating members 30 is formed by a metallic elastic plate and is provided with a flat base 31 which is placed on the base 22*a* of the main body 22 in the separating pawl holder 20, and a pawl portion 32 extending from the base 31 in a direction reverse to a rotating direction of the transport roller 11 as illustrated in FIG. 3. The separating member 30 may be arranged in a manner to provide the pawl portion 32 with elasticity at least in a portion from the base 31 to the leading end.

The pawl portion 32 is curved convexly so as to be in the same direction as that of a circumferential surface of the transport roller 11, and is brought in contact with the circumferential surface of transport roller 11 from horizontal and tangential directions making a leading end or tip 32*a* of the pawl portion 32 as a flat portion. In the present embodiment, the pawl portion 32 is curved in an arc, however, it is not necessarily curved in an arc. For instance, it may preferably be arranged in a bent shape having a proper number of angles.

The size of the leading end portion 32*a* of the pawl portion 32 becomes smaller in width at the tip portion, and each side edge tapers away. At each tapered side edge on the leading end portion 32*a* of the pawl portion 32, there is provided a triangular sheet guide 33 which is vertically extending upward.

Each one of the sheet guides 33 forms an inclined guide side edge portion 33*a* to be gradually separated from the transport roller 11 as an edge on the leading end of the pawl portion 32 is slantingly risen toward the rear.

As shown in FIG. 2, each one of the separating members 30 is provided on each side in a direction perpendicular to a sheet transporting direction a sheet is forwarded between the transport roller 11 and pressure roller 12.

A sheet of each size is transported along the left side end portion in a sheet transporting direction as a datum side portion as shown by the arrow in FIG. 2, and adjacent to said left side end portion, there is provided a piece of separating member 30. Another separating member 30 adjoining to the separating member 30 is arranged on the opposite side of the datum side portion in order to cope with a case when a post-card sized sheet is transported. Each of the separating members 30 is provided corresponding to the side of each sheet size in order of A5, B5, A4 and B4.

Figure 4:
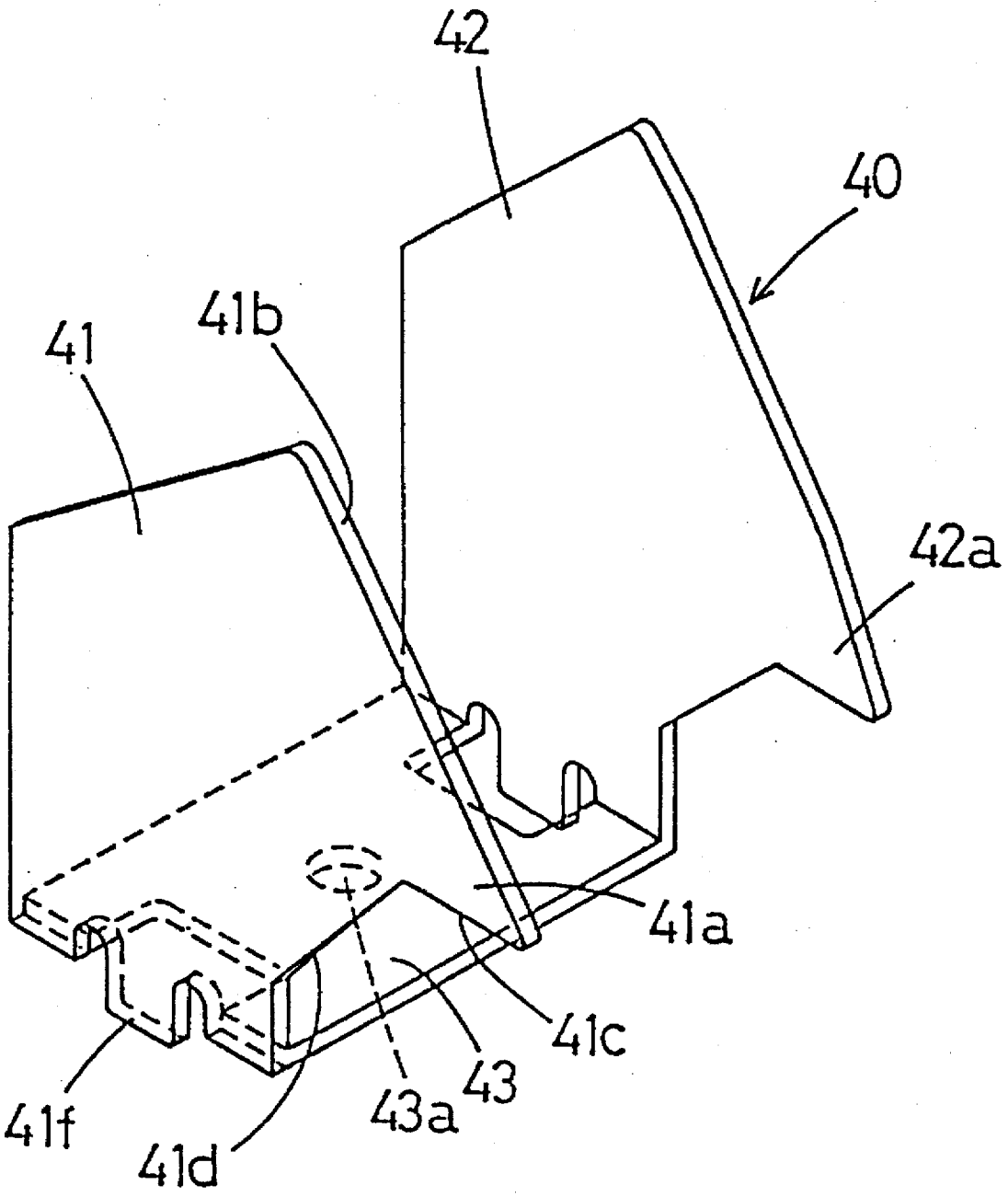
FIG. 4 is a perspective view illustrating an example of a sheet guide member which is also used as a separating pawl protective member of the device shown in FIG. 1.

Each of the separating members 30 is positioned in a predetermined posture by a sheet guide member 40. As shown in FIG. 4, each one of the sheet guide members 40 is provided with a flat pawl pressing plate or arm 41 verticaly positioned along the center in a direction of width at the pawl portion 32 of the separating member, a flat guide plate 42 disposed in parallel with the pawl pressing plate 41 with a proper space and a connecting plate 43 arranged at a lower end portion between the pawl pressing plate 41 and the guide plate 42. The pawl pressing plate 41, guide plate 42 and connecting plate 43 are integrally formed, for instance, by a plate to constitute each one of the sheet guide members 40.

At the central portion of the connecting plate 43, there is provided a tapped hole 43*a* into which a bolt 24 is inserted penetrating through a penetrating hole 31*a* provided on the base 31 of the separating member 30 shown in FIG. 3 and a base 22*a* of the separating pawl holder 20. Under a state that the sheet guide member 40 is fixed above the separating member 30, the pawl pressing plate 41 is disposed along the central portion in a direction of width at the pawl portion 32 of the separating member 30, and the leading end 32*a* is retractably supported from the opposite side relative to the transport roller 11 by pressing the central portion in a direction of width of the pawl portion 32.

A lower end surface of the pawl pressing plate 41 is positioned below the connecting plate 43, and is disposed on the base 22*a* of the main body 22 in the separating pawl holder 20. At the central portion on the lower end surface of the pawl pressing plate 41, a positioning engaging pawl 41*f* is provided extending lower than the lower end surface of the pawl pressing plate 41.

Figure 5:
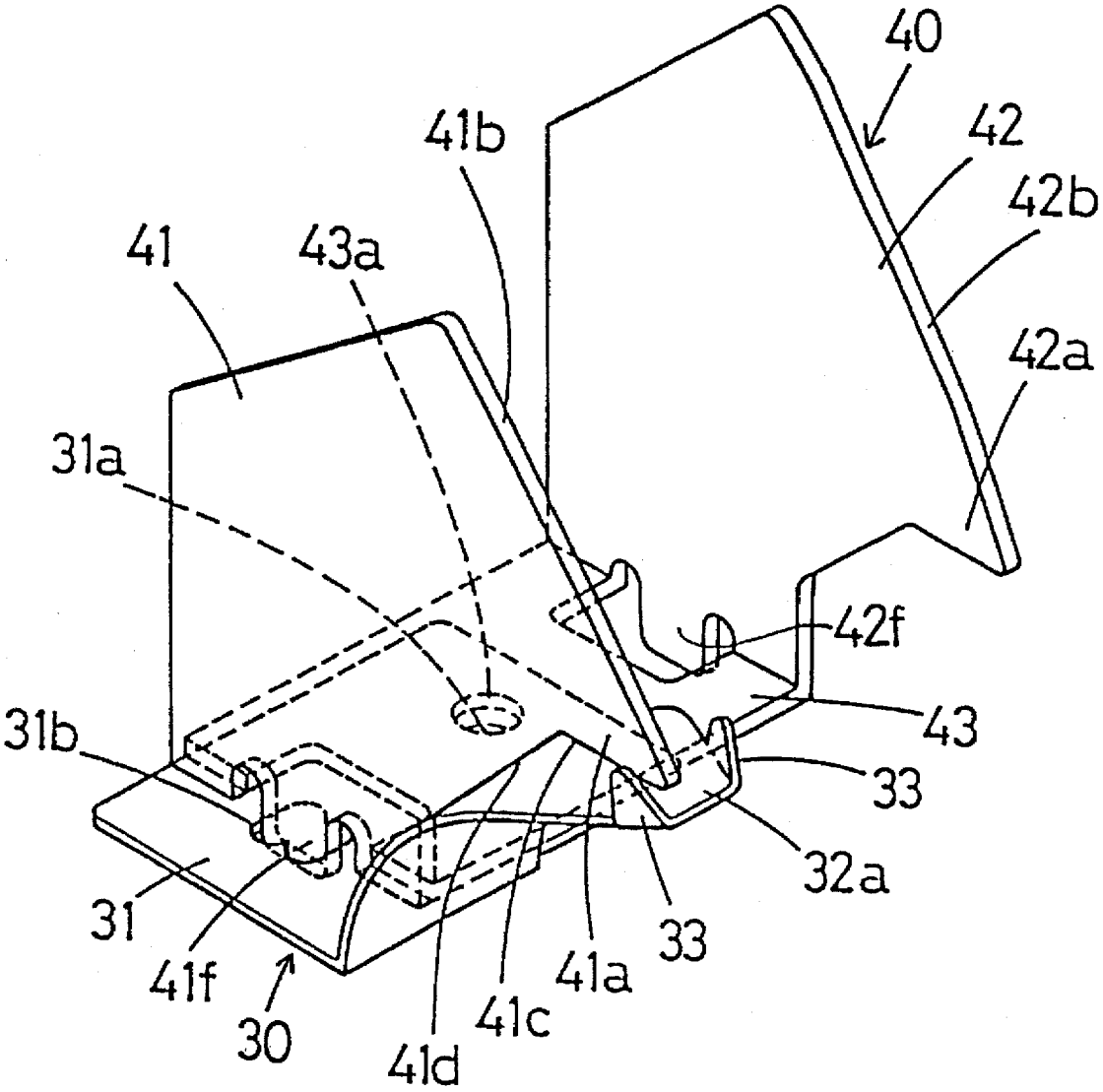
FIG. 5 is a perspective view showing how the sheet guide member illustrated in FIG. 4 is attached to the separating pawl.

The engaging pawl 41*f* is fitted on both a positioning hole 31*b* provided on the base 31 of the separating member 30 as shown in FIG. 5 and an unillustrated positioning hole provided on the base 22*a* of the main body 22 in the separating pawl holder 20. On the lower end surface of a guide plate 42, there is also provided a similar engaging pawl 42*f*, and is fitted on a positioning hole provided on the base 22*a* of the main body 22 in the separating pawl holder 20.

The pawl pressing plate 41 guides a sheet separated from the transport roller 11 by the leading end portion 32*a* of the separating pawl 32 for a next process. In order to protect the pawl portion 32 from a pressing force of jammed paper, the leading end of the pawl pressing plate 41 which faces reversely to a sheet transporting direction is shaped into a sharply projected triangular protrusion 41*a* and extends to reach above the transport roller 11. The protrusion 41*a* is formed by a guide side edge portion 41*b* which is an inclined side edge on the side of the transport roller 11 in the pawl pressing plate 41 and a substantially horizontal leading end side edge portion 41*c* which stretches to the guide side edge portion 41*b* in an acute angle at the leading end of the protrusion 41*a*.

At a downstream side of the leading end side edge portion 41*c* in a direction of rotation of the transport roller 11, a connecting side edge portion 41*d* extends along a direction of a tangent line in the central portion of the curved pawl portion 32, and is further stretching to a vertically positioned lower end side edge 41*e* at a downstream side in a direction of rotation of the transport roller 11.

The leading end portion of the lower leading end side edge portion 41*c* in the protrusion 41*a* of the pawl pressing plate 41 is positioned between each one of the sheet guides 33 provided on both side edges of the leading end portion 32*a* as shown in FIG. 5, and is brought in a pressed contact with the upper surface at the central portion in a direction of width of the leading end portion 32*a* of the pawl portion 32 to retractably support the leading end portion 32*a* under a backup state.

The central portion of connecting side edge portion 41*d* which is stretched to the leading end side edge portion 41*c* faces opposite to the central portion of curved portion of the pawl portion 32 with a proper space therebetween. The lower side edge portion 41*e* which is substantially vertically positioned is pressed in contact with a base end on the side of the base 31 of the pawl portion 32 at its lowermost end portion.

In the separating member 30, the leading end portion 32*a* and the base 31 are supported by the separating pawl holder 20 which is a fixed portion around the periphery of the transport roller 11 and the pawl pressing plate 41 at two locations, i.e. at the base 31 and leading end portion 32*a* of the pawl portion 32. Since the leading end side edge portion 41*c* and lower end side edge portion 41*e* of the pawl pressing plate 41 are pressed in contact with the leading end portion 32*a* and base end of the pawl portion 32, the pawl portion 32 is securely held under a predetermined curved arc shape along the transport roller 11. The pawl portion 32 is provided with elasticity, and therefore, the leading end portion 32 is capable of moving forward and backward in a sheet transporting direction along the leading end side edge portion 41*c* of the pawl pressing plate 41 accompanying elastic deformation in a space between the pawl pressing plate 41.

The guide side edge portion 41*b* above the protrusion 41*a* of the pawl pressing plate 41 is inclined similarly to the guide side edge portion 33*a* of the guide 33 which is provided at the leading end portion 32*a* of the pawl portion 32, and a sheet passed through between the transport roller 11 and pressure roller 12 is guided to the guide side edge portion 41*b* from each one of the sheet guides 33.

A guide plate 42 which forms a counterpart to the pawl pressing plate 41 is positioned on the side of outside of the base 31 in the separating member 30. Above the pawl pressing plate 41 and guide plate 42, there is provided a piece of roller shaft 51 in parallel with the transport roller 11, and a plurality of feed rollers 52 are fitted on the roller 51 so as to be positioned between the pawl pressing plate 41 and the guide plate 42 in each one of the sheet guide members 40.

The guide plate 42 is substantially similar in shape to the pawl pressing plate 41, and is provided with a protrusion 42*a* projecting toward the transport roller 11 at the central portion in a vertical direction. A guide side edge portion 42*b* above the protrusion 42*a* stretches upward longer than the guide side edge portion 41*b* of the pawl pressing plate 41 so as to close to the feed roller 52.

In the sheet separating device 2 which is constructed in a manner as described above, the base 31 of the pawl portion 32 is attached to the separating pawl holder 20 which is a fixed portion around the transport roller 11 and stretches reversly to a revolving direction of the transport roller 11. Since the leading end portion 32*a* is retractably supported by the fixed portion around the transport roller 11 at the opposite side of the transport roller 11, and is brought in contact with circumferential surface of the transport roller 11, a sheet being fed from a side opposite to the leading end portion 32*a* of the pawl portion 32 in close contact with circumferential surface of a rotating transport roller 11 is separated from the circumferential surface of the transport roller 11 in a manner to scoop up the sheet by the leading end portion 32*a* of the pawl portion 32 so that the sheet is passed through without winding the transport roller 11.

Figure 6:
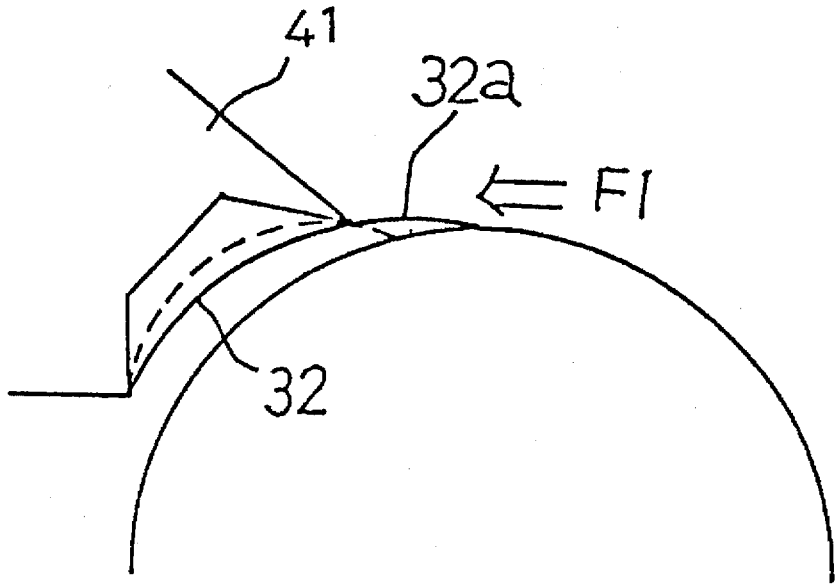
FIG. 6 is an explanatory view showing a state when a force is added to a separating pawl in a circumferential direction of a rotatable member.

At this stage, even if a pressing force F1 is added to the leading end portion 32*a* of the pawl portion 32 by a sheet which is brought in contact with from a direction along the circumferential surface of the transport roller 11 as shown in FIG. 6, the sheet is prevented from cutting into the surface of the transport roller 11 since the leading end portion 32*a* is retractably held by said fixed portion, and a convex curve is formed on the same side of the circumferential surface of the transport roller 11 from the base 31 of the pawl portion 32 to the leading end. Furthermore, making use of elasticity it is provided with, the leading end portion 32*a* is only momentarily pushed back accompanying a natural deformation as shown by two dotted chain line in FIG. 2.

Since the pawl portion 32 is formed in a curved shape, a sheet is brought in contact with the circumferential surface of the transport roller 11 from a direction of a tangent line without becoming bulky around the circumferential surface of the transport roller 11, and a contact pressure is controlled smaller with a secure contact for performing a sufficient separating function.

Figure 7:
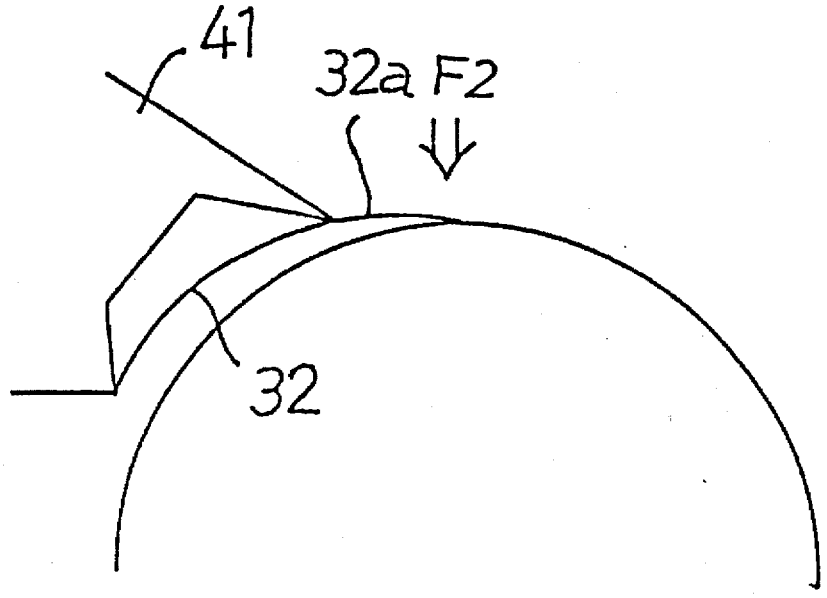
FIG. 7 is an explanatory view showing a state when a force is added to a separating pawl in a direction of diameter of a rotatable member.

Even if a load F2 is added from a direction of diameter of the transport roller 11 caused by a jammed paper or the like which is different from a normal force as illustrated in FIG. 7, the leading end portion 32*a* of the pawl portion 32 is only deformed along the circumferential surface of the transport roller 11 naturally sliding on the circumferential surface of the transport roller 11 without cutting into the surface of the transport roller 11, and the transport roller 11 is protected from being broken. Furthermore, even if the surface of the leading end portion 32*a* of the pawl portion 32 and the surface of the transport roller 11 wear away, the pawl portion 32 is kept in satisfactory contact with the surface of the transport roller 11 making a soft contact accompanied by its elastic deformation, and separate a sheet surely from the circumferential surface of transport roller 11.

Figure 8:
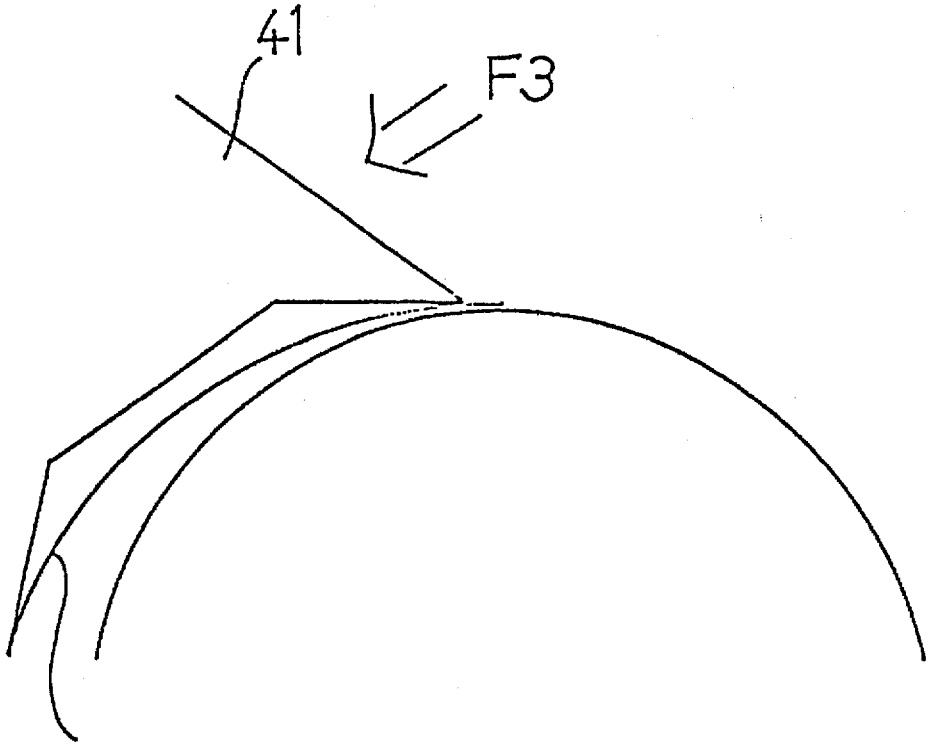
FIG. 8 is an explanatory view showing a state how a separating pawl is protected from a jammed sheet by a sheet guide member.

In the case when a pressing force F3 shown in FIG. 8 is added by a jammed paper, the pressing force F3 does not reach the pawl portion 32 and acts on the sheet guide member 41 only. In other words, since the pawl portion 32 is protected by the sheet guide member 41, a damage of the pawl portion 32 is avoided. Furthermore, the pawl portion 32 is prevented from cutting into the surface of the transport roller 11 to avoid a damage thereon.

Figure 9:
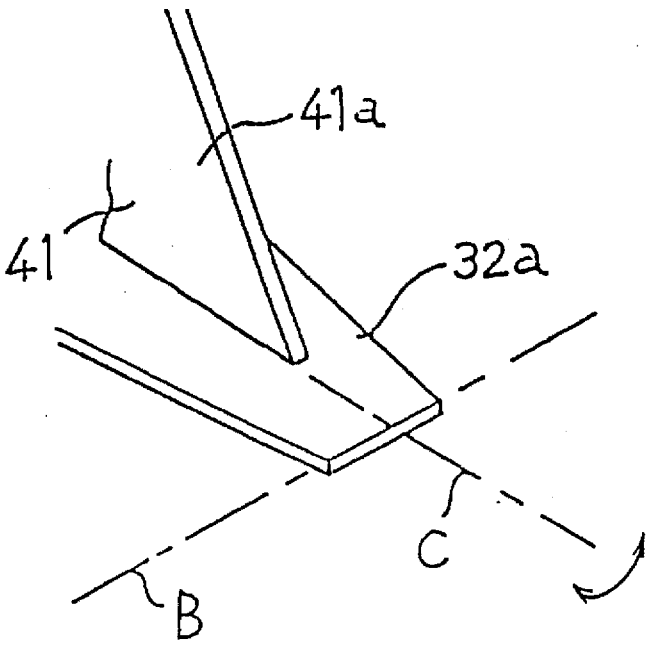
FIG. 9 is an explanatory view showing a state when a separating pawl is arranged to be swung around a center line in a longitudinal direction.

A sheet separated from the surface of the transport roller 11 is guided to the inclined guide side edge portion 33*a* provided on the leading end portion 32*a* of the pawl portion 32, and a sheet transporting direction is directed slantingly above. The sheet is then guided by the guide side edge portion 41*b* of the pawl pressing plate 41 in the sheet wide member 40 and the guide side edge portion 42*a* of the guide plate 42 to be transported to the feed roller 52 and is further forwarded to a predetermined direction. The leading end portion 32*a* of the pawl portion 32 is made flat and forms a line of contact B with a rotatable member such as transport roller 11 which functions to separate a sheet as shown in FIG. 9. The line of contact B is in parallel with a shaft of the rotatable member.

As illustrated in FIG. 9, by supporting the pawl portion 32 of the separating member movably around two dotted chain line C pependicularly intersecting the line of contact with the transport roller 11 which acts on the pawl portion 32, the leading end portion 32*a* of the pawl portion 32 is brought in contact with the surface of the transport roller 11 and the like satisfactorily. Therefore, even if the surface of the transport roller 11 wears away, the leading end portion 32*a* of the pawl portion 32 is surely brought in contact with the surface of the transport roller 11 by an elastic force of the pawl portion 32, and a sheet which is in close contact with the surface of transport roller 11 is surely separated from the surface of the transport roller 11.

In the above-described embodiment, the leading end portion of the separating member 30 is held opposite to the surface of the transport roller 11 only, however, the separating pawl may be arranged to act on the surface of the pressure roller 12 in the present invention. Other than the fixing roller, the separating member may be applied to a rotatable member such as photoconductor, intermediate transfer drum as a separating device.

Figure 10:
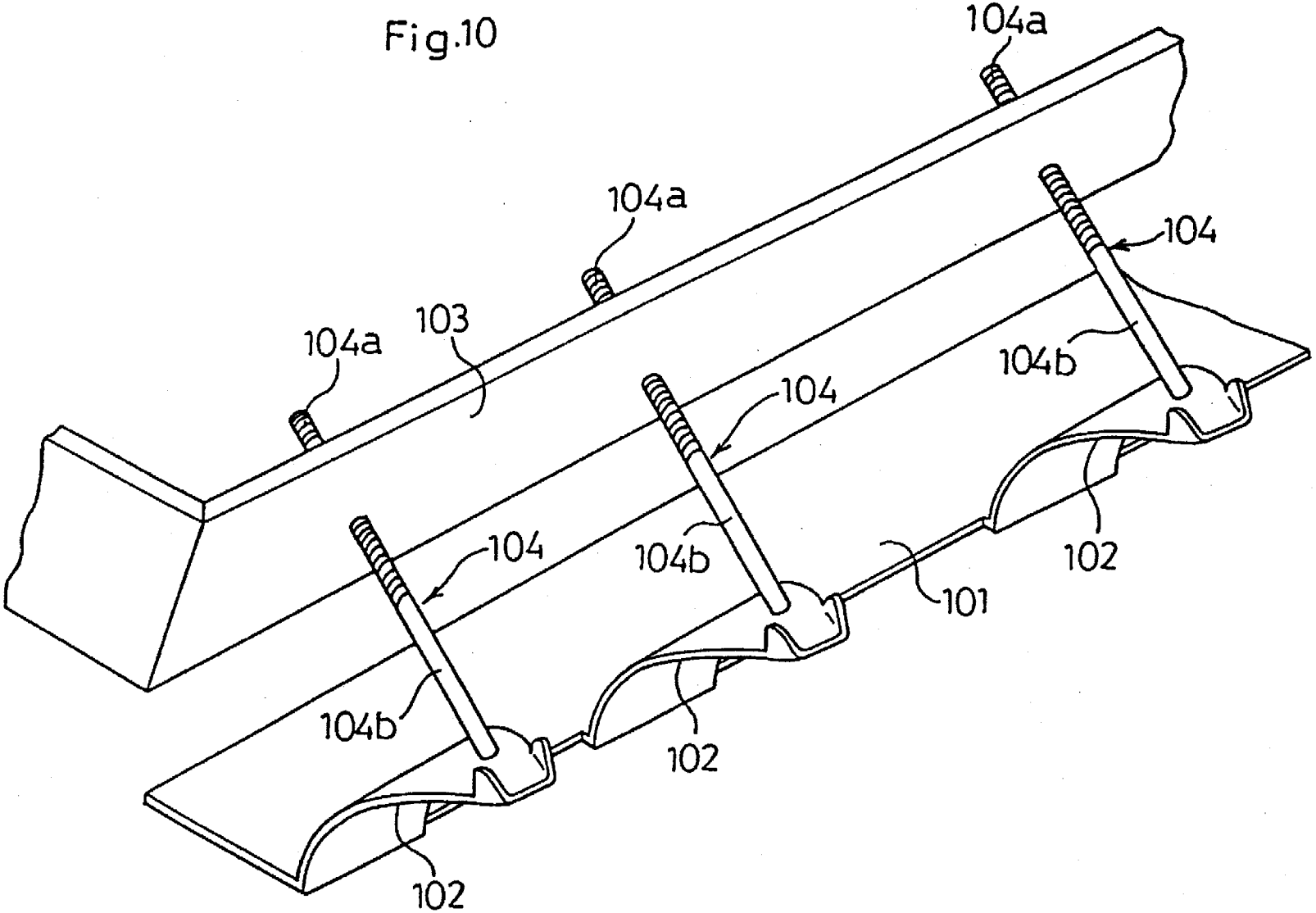
FIG. 10 is a perspective view showing a second embodiment of a sheet separating device of the present invention.

FIG. 10 shows a second embodiment of the present invention.

In the first embodiment of the present invention, the separating pawl 32 is individually formed and held on the separating holder 20 with a predetermined pitch. In the present embodiment, however, a plurality of separating pawls 102 are integrally formed by a sheet of elastic plate 101, and each one of the separating pawls 102 is pressed toward an unillustrated rotatable member by each one of the screws 104 screwed on a fixed portion 103 which is attached together with a base of the elastic plate 101.

The screw 104 is provided with a screw thread 104*a* from one end where the fixed portion 103 is screwed to a halfway point, and a pressing condition against the separating pawl 102 is adjusted by regulating a position where the fixed portion 103 is screwed within a space the screw thread is provided. A portion 104*b* where the screw thread 104*a* is not formed and presses the separating pawl 102 contributes to guide a sheet separated from the rotatable member by the separating pawl 102.

With such an arrangement to integrally form a plurality of separating pawls 102 on a sheet of elastic plate 101, the number of manufacturing processes as well as the number of parts can be reduced, and a manufacturing cost of the device is eventually reduced. With an adoption of a method of pressing the separating pawl 102 by using the screws 104, a pressing action of the separating pawl 102 against the rotatable member can be controlled finely and accurately. The fixed portion 103 may be arranged as a portion integrally formed by the elastic plate 101.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A separating device for separating a sheet-like member from a surface of a rotatable member in an image forming apparatus, said device comprising a separating pawl having a separating tip in engaging contact with the surface of the rotatable member and a base end rigidly connected with a body of the separating device, said separating pawl being made up of a flexible, elastic material and having a preformed convex shape positioned facing in the same direction as that of a circumferential surface of the rotatable member.

2. A separating device as claimed in claim 1, wherein the separating pawl forms an arch shape in the same direction as that of the circumferential surface of the rotatable member.

3. A separating device as claimed in claim 1, further comprising a pressing arm wherein one end is fixed on the body of the separating device and the other end is brought in contact with a portion between the separating tip and the base end of the separating pawl.

4. A separating device as claimed in claim 3, wherein said pressing arm is brought in contact with a portion adjacent to the separating tip of the separating pawl and facing a convex central portion of the separating pawl.

5. A separating device as claimed in claim 3, wherein the pressing arm is made up of a plate vertically disposed relative to the circumferential surface of the rotatable member, and being brought in contact with the separating pawl at a point.

6. A separating device as claimed in claim 3, wherein the pressing arm includes a guide surface for guiding a sheet separated from the rotatable member by the separating pawl.

7. A separating device as claimed in claim 6, wherein said guide surface is tilted toward a forward direction side of a sheet separated at a position adjacent to the separating tip of the separating pawl.

8. A separating device as claimed in claim 1, wherein said separating pawl is provided with a guide for guiding a sheet separated from the rotatable member by the separating pawl.

9. A separating device as claimed in claim 8, wherein the guide surface is formed on a side edge adjacent to the separating tip of the separating pawl, and is provided with a guide surface tilted toward a forward direction side of a sheet separated from a side of the separating tip.

10. A separating device for separating a sheet from a circumferential surface of a rotatable member, comprising:

a base;

a flexible elastic plate rigidly connected to said base and having a leading end facing a rotatable member, and being convexly preformed in a same direction as that of a circumferential surface of the rotatable member; and a pressing arm having a base end connected to the base, and a leading end of the pressing arm being in contact with a convex side of the flexible elastic plate, and being positioned so as to cause a leading tip of the flexible plate to be in contact with the rotatable member.

11. A separating device as claimed in claim 10, wherein said pressing arm is brought in contact with a portion adjacent to the leading tip of flexible elastic plate.

12. A separating device as claimed in claim 11, wherein the pressing arm faces a convex central portion of an arch formed by the flexible elastic plate having a predetermined space.

13. A separating device as claimed in claim 10, wherein the pressing arm is in contact with the flexible elastic plate at a point.

14. A separating device for separating a sheet from a circumferential surface of a rotatable member, comprising:

a base frame; and an elastic plate having a length in a direction of width of a rotatable member and forming a plurality of pawls extruded toward the rotatable member with a predetermined space, each one of the pawls being deformed convexly in the same direction as that of a circumferential surface of the rotatable member.

15. A separating device as claimed in claim 14, further comprising a plurality of pressing arms connected to the base frame with their base ends, the leading end of each one of the pressing arms being in contact with a convex side of the pawl to be brought in contact with the rotatable member.

16. A separating device as claimed in claim 15, wherein said pressing arm includes a screw screwed in said base frame.

17. A separating device is claimed in claim 16, wherein said screw is not provided with thread on a part where the screw is brought in contact with the pawl.

18. A separating device for separating a sheet from a surface of a rotatable member, comprising:

a base;

a flexible, elastic plate rigidly connected to said base and having a leading end of the elastic plate facing the rotatable member, the leading end being convexly preformed in a same direction as that of the surface of the rotatable member; and a pressing arm having a base end connected to the base, and a leading end of the pressing arm being in contact with a convex side of the elastic plate, and being positioned so as to cause a leading tip of the elastic plate to be in contact with the surface of the rotatable member;

said pressing arm extending substantially perpendicular to the surface of the rotatable member, and said arm includes a guide edge for guiding sheets that are separated from the rotatable member.

19. A separating device as claimed in claim 18, wherein the guide edge defines a path along which the separated sheet is transported.

20. A separating device for separating a sheet-like member from a surface of a rotatable member in an image forming apparatus, said device comprising a separating pawl having a separating tip in engaging contact with the surface of the rotatable member and a base end connected with a body of the separating device, said separating pawl being made up of a flexible, metallic elastic plate and having a preformed convex shape positioned facing in the same direction as that of a circumferential surface of the rotatable member.

21. A separating device for separating a sheet-like member from a surface of a rotatable member in an image forming apparatus, said device comprising a separating pawl having a separating tip in engaging contact with the surface of the rotatable member and a base end connected with a body of the separating device, said separating pawl being made up of a flexible, elastic plate and having a preformed convex shape positioned facing in the same direction as that of a circumferential surface of the rotatable member so that the separating pawl is deformed along the circumferential surface of the rotatable member naturally sliding on the circumferential surface of the rotatable member.

22. A sheet separating device, comprising:

a base;

a flexible plate having a first end fixed to said base and a free second end arranged in engaging contact with a surface of a rotatable drum; and a rigid pressing arm having a first end arranged adjacent the free second end of the plate so as to form a gap between the rotatable drum and the pressing arm, said gap being sufficiently narrow so that the free second end of the flexible plate can only move in a direction tangential to the surface of the rotatable drum, said rigid pressing arm being secured to the base so as to prevent movement of the pressing arm during movement of the flexible plate.

23. The separating device of claim 22, further comprising a guide surface arranged on the free second end of the flexible plate at an angle with respect to the surface of the rotatable drum so as to guide a sheet from the rotatable drum to the rigid pressing arm.

24. The separating device of claim 23, further comprising a guide surface on the rigid pressing arm to continue guiding a sheet from the guide surface of the flexible plate.

25. The separating device of claim 22, wherein the first end of the rigid pressing arm contacts the free second end of the flexible plate.

* * * * *